US006212353B1

(12) United States Patent
Douvdevani et al.

(10) Patent No.: US 6,212,353 B1
(45) Date of Patent: Apr. 3, 2001

(54) METHOD AND APPARATUS FOR CLEANING AN IMAGE TRANSFER MEMBER

(75) Inventors: Shmuel Douvdevani, Tel-Aviv; Alex Feygelman, Petach-Tikva; Shlomo Yitzhaik, Nes-Ziona, all of (IL)

(73) Assignee: Indigo N.V., Maastricht (NL)

( * ) Notice: Subject to any disclaimer, the term of this patent is extended or adjusted under 35 U.S.C. 154(b) by 0 days.

(21) Appl. No.: 09/319,360

(22) PCT Filed: Dec. 3, 1996

(86) PCT No.: PCT/IL96/00173

§ 371 Date: Aug. 4, 1999

§ 102(e) Date: Aug. 4, 1999

(87) PCT Pub. No.: WO98/25188

PCT Pub. Date: Jun. 11, 1998

(51) Int. Cl.[7] ..... G03G 15/16; G03G 21/00
(52) U.S. Cl. ..... 399/308; 399/127
(58) Field of Search ..... 399/343, 297, 399/302, 308, 127, 49, 72

(56) References Cited

U.S. PATENT DOCUMENTS

| | | | | |
|---|---|---|---|---|
| 3,862,848 | | 1/1975 | Marley . | |
| 3,893,761 | | 7/1975 | Buchan et al. . | |
| 4,531,825 | | 7/1985 | Miwa et al. . | |
| 4,684,238 | | 8/1987 | Till et al. . | |
| 4,690,539 | | 9/1987 | Radulski et al. . | |
| 5,047,808 | | 9/1991 | Landa et al. . | |
| 5,089,856 | | 2/1992 | Landa et al. . | |
| 5,103,260 | * | 4/1992 | Tompkins et al. | 399/72 X |
| 5,103,266 | | 4/1992 | Tsuyoshi et al. . | |
| 5,122,835 | * | 6/1992 | Rushing et al. | 399/499 |
| 5,153,658 | * | 10/1992 | Lundy et al. . | |
| 5,173,735 | * | 12/1992 | Kusumoto | 399/302 |
| 5,187,526 | | 2/1993 | Zaretsky . | |
| 5,376,491 | | 12/1994 | Krumberg et al. . | |
| 5,508,790 | | 4/1996 | Belinkov et al. . | |
| 5,510,886 | | 4/1996 | Hiroyuki et al. . | |
| 5,689,780 | * | 11/1997 | Tamura et al. . | |
| 5,765,083 | * | 6/1998 | Shinohara | 399/49 X |
| 5,809,387 | * | 9/1998 | Takeuchi et al. | 399/302 |
| 5,933,680 | * | 8/1999 | Nishimura | 399/49 |

FOREIGN PATENT DOCUMENTS

| | | | |
|---|---|---|---|
| 0 769 729 | | 4/1997 | (EP) . |
| 60-257475 | | 12/1985 | (JP) . |
| 4-215672 | * | 8/1992 | (JP) . |
| 7-28342 | * | 1/1995 | (JP) . |
| 7-134453 | | 5/1995 | (JP) . |
| 8-106242 | * | 4/1996 | (JP) . |
| 10-186873 | * | 7/1998 | (JP) . |
| WO 89/06384 | | 7/1989 | (WO) . |
| WO 94/23347 | | 10/1994 | (WO) . |
| WO 96/01442 | | 1/1996 | (WO) . |
| WO 96/11426 | | 4/1996 | (WO) . |
| WO 96/31809 | | 10/1996 | (WO) . |

* cited by examiner

*Primary Examiner*—Susan S. Y. Lee
(74) *Attorney, Agent, or Firm*—Fenster & Company Patent Attorneys, Ltd.

(57) ABSTRACT

An imaging device comprising an imaging surface on which images are formed; an image transfer surface which receives the images onto an image transfer portion thereof at a first transfer region and from which images are transferred at a second transfer region; and a cleaning arrangement including a cleaning surface which engages the image transfer portion at a cleaning region of the transfer surface. The image transfer portion receives a non-image pattern from the imaging surface at the first transfer region and the cleaning surface collects the non-image pattern at the cleaning region.

25 Claims, 4 Drawing Sheets

METHOD AND APPARATUS FOR CLEANING AN IMAGE TRANSFER MEMBER

RELATED APPLICATIONS

The present application is a US national stage application of PCT application PCT/IL96/00173, filed Dec. 3, 1996.

FIELD OF THE INVENTION

The present invention relates to cleaning of image transfer surfaces, particularly the surfaces of image transfer members used in liquid toner imaging.

BACKGROUND OF THE INVENTION

The use of image transfer members in electrostatic imaging is well known. Typically, an intermediate transfer surface is used to transfer a toner image from an imaging surface to a final substrate. This transfer is typically aided by heat and pressure.

Various types of intermediate transfer members are known and are described, for example in U.S. Pat. Nos. 3,862,848, 4,684,238, 4,690,539 and 4,531,825, the disclosures of all of which are incorporated herein by reference.

Belt-type intermediate transfer members for use in electrophotography are known in the art and are described, inter alia, in U.S. Pat. Nos. 3,893,761, 4,684,238 and 4,690,539, the disclosures of all of which are incorporated herein by reference.

The use of intermediate transfer members and members including transfer blankets for offset ink printing is also well known. Such blankets have characteristics which are suitable for ink transfer but are generally not usable, per se, for liquid toner imaging.

Desirably, the transfer of the toner image from the intermediate transfer surface onto the final substrate is complete. However, it is appreciated that some residual toner may remain on the surface after each transfer. The residual toner typically comprises deformed toner particles, some of which may be at least partially fused to other particles, which may adhere to the transfer surface and may accumulate to substantial amounts after many imaging cycles. This accumulation of the residual toner particles results in non-homogeneous and/or unclean transfer of the toner images onto the final substrate.

Cleaning of intermediate transfer members is known in the art. To enable continuous cleaning while avoiding erasure of the image being transferred, the cleaning station in other prior art devices is located downstream of the site at which the image is transferred onto the final substrate, prior to the transfer of a subsequent image to the intermediate transfer member.

In other known systems, the intermediate transfer member is periodically cleaned by printing a series of toner patterns, hereinafter referred to as "non-images", onto the final substrate. Printing of the non-images is based on applying a substantially continuous layer of fresh toner onto the intermediate transfer member and transferring the layer of liquid toner onto a final substrate, whereby the deformed residual toner particles adhere to the fresh toner and are thus removed from the intermediate transfer member. A substantially continuous or continuous layer of toner on the intermediate transfer member is typically obtained by developing a substantially continuous non-image on the imaging surface and transferring the developed non-image onto the intermediate transfer member.

To economize on the use of liquid toner, the substantially continuous non-image can be formed of a plurality of screen images each of which covers only a predetermined portion of the surface area of the intermediate transfer member. A sequence of such screen images, each preferably using a different color toner, provides complete coverage of the intermediate transfer member and collects substantially all the residual toner of all the color toners. It is appreciated that different color toners have different physical properties and, therefore, some color toners are more effective, e.g. more adhesive, than others in removing residual toner particles.

Cleaning of the intermediate transfer member by printing on the final substrate, as described above, generally requires at least eight imaging cycles for each cleaning session. The final substrate bearing the printed non-images which are formed during the cleaning session cannot be re-used and is, thus, discarded after the cleaning session, increasing maintenance costs. When the imaging system is designed for printing on a continuous final substrate as described, for example, in PCT publications WO 96/01442 and 96/31809, each cleaning session introduces a series of undesired non-images between consecutive images, interrupting the sequence of images formed on the final substrate.

SUMMARY OF THE INVENTION

It is an object of some aspects of the present invention to provide a method and apparatus for cleaning an image transfer surface in imaging apparatus, especially in imaging apparatus using electrostatically charged liquid toner.

According to one aspect of the present invention, a cleaning roller having a sticky surface is selectively brought to contact with the image transfer surface. A toner pattern, hereinafter also referred to as a toner non-image, is developed on an imaging surface of the imaging apparatus, and is transferred onto the image transfer surface. Residual toner on the image transfer surface, from previous imaging cycles, adheres to the fresh toner of the non-image. When the cleaning roller engages the image transfer surface, toner of the non-image is transferred onto the sticky surface of the cleaning roller. Preferably, in this aspect of the present invention, the cleaning roller selectively engages the image transfer surface only during predefined cleaning sessions. Therefore, the cleaning roller can be positioned anywhere along the image transfer surface, e.g. upstream of the location at which images are transferred onto a final substrate during normal printing. Furthermore, according to this aspect of the present invention, the image transfer surface does not engage the final substrate during the cleaning sessions.

According to another aspect of the present invention, a cleaning roller having a sticky surface continuously engages the image transfer surface, collecting residual toner particles therefrom. Periodically, a predefined toner non-image is formed on the surface of the intermediate transfer member and is not transferred onto the final substrate. The non-image, which includes fresh liquid toner, is collected by the cleaning roller and a layer of fresh toner is coated onto the surface of the roller. Thus, according to this aspect of the present invention, printing of non-images is utilized to renew the stickiness of the sticky surface. Since the cleaning roller continuously engages the image transfer surface, the cleaning roller is positioned downstream of the location at which images are transferred onto the final substrate.

Under some circumstances, it may be desirable to increase the stickiness of the toner on the roller by heating the roller or by plasticizing the toner on the roller by wetting it with carrier liquid or with a heavy mineral oil having a very low volatility, a high viscosity and a high flash point, such as Marcol 82. However, under normal circumstances, utilizing a heated intermediate transfer member which heats the roller by conduction, such additional measures are generally unnecessary and may even result in less optimal operation of the system.

It is appreciated that residual toner from incompletely transferred images which is transferred onto the cleaning roller accumulates gradually, over many cleaning sessions, into a thick layer of dried toner which enlarges the effective diameter of the cleaning roller. Therefore, in preferred embodiments of the present invention, the accumulated layer of toner is removed periodically from the cleaning roller.

In some preferred embodiments of the present invention, the non-images printed during the cleaning/surface renewal sessions include "sky shot" images, i.e. images which provide a substantially full coverage of the usable area of the intermediate transfer surface. In other preferred embodiments of the present invention, the non-images include predefined patterns which do not fully cover the usable area on the image transfer surface but which are sufficiently dense to interact substantially with all the residual toner particles. Additionally or alternatively, the non-images include a series of complementary patterns which aggregate to provide a substantially full coverage of the image transfer surface.

In some preferred embodiments of the invention, only an area of the image transfer surface corresponding to the surface area of the cleaning roller is covered by the non-images, whereby the stickiness of the cleaning surface is renewed with minimal wastage of liquid toner. The renewed sticky surface efficiently removes residual toner from the image transfer surface.

There is thus provided, in accordance with a preferred embodiment of the present invention, an imaging device comprising:

an imaging surface on which images, preferably toner images and more preferably liquid toner images are formed;

an image transfer surface which receives the images at a first transfer region and from which the images are transferred at a second transfer region downstream of the first transfer region; and a cleaning arrangement which engages said image transfer surface at a cleaning region of the image transfer surface situated between the first and second transfer regions downstream of said first transfer region and upstream of the second transfer region.

Preferably, the cleaning arrangement comprises a cleaning surface which engages the image transfer surface.

In a preferred embodiment of the invention, the image transfer surface receives a non-image pattern, preferably a toner pattern and more preferably a liquid toner pattern, from said imaging surface at said first image transfer region and wherein said cleaning surface collects said non-image pattern at said cleaning region.

There is further provided in a preferred embodiment of the invention an imaging device comprising:

an imaging surface on which images, preferably toner images and more preferably liquid toner images are formed;

an image transfer surface which receives the images at a first transfer region and from which images are transferred at a second transfer region downstream of the first transfer region; and a cleaning arrangement including a cleaning surface which engages said image transfer surface at a cleaning region of the transfer surface, wherein said image transfer surface receives a non-image pattern, preferably a toner pattern and more preferably a liquid toner pattern, from said imaging surface at said first transfer region and wherein said cleaning surface collects said non-image toner pattern at said cleaning region.

Preferably, the cleaning region is downstream of the second transfer region and upstream of the first transfer region.

In a preferred embodiment of the invention, the cleaning surface continuously engages the image transfer surface.

In a preferred embodiment of the invention the non-image pattern comprises a pattern which provides substantially full coverage of at least a portion of the image transfer surface. Preferably, the non-image pattern comprises a pattern which covers an area on said image transfer surface corresponding to the area of said cleaning surface. Preferably said non-image pattern comprises a non-continuous pattern which covers predetermined portions of the image transfer surface.

In a preferred embodiment of the invention, the cleaning arrangement engages the image transfer surface only during predefined cleaning sessions.

In a preferred embodiment of the invention, the cleaning surface comprises a surface of a cleaning roller, preferably one having a sticky surface.

There is further provided, in accordance with a preferred embodiment of the invention, a method of cleaning an image transfer surface in an imaging device comprising an imaging surface on which images, preferably toner images and more preferably liquid toner images, are formed and an image transfer surface which receives images at a first transfer region and from which the images are transferred at a second transfer region, the method comprising:

providing a cleaning member;

intermittently engaging said transfer surface with a cleaning member between said first and second transfer regions downstream of said first transfer region.

Preferably the method further comprises:

developing a predefined non-image pattern on said imaging surface; and transferring said predefined non-image pattern onto said image transfer surface at said first transfer region.

There is further provided in accordance with a preferred embodiment of the invention a method of cleaning an image transfer surface in an imaging device comprising an imaging surface on which images, preferably toner images and more preferably liquid toner images, are formed, an image transfer surface which receives images at a first transfer region and from which the images are transferred at a second transfer region and a cleaning surface which engages the image transfer surface at a cleaning region to remove residual image material remaining on the transfer surface after transfer of the images therefrom, the method comprising:

periodically developing a predefined, non-image, pattern on said imaging surface; and transferring said predefined non-image pattern, preferably a toner pattern and more preferably a liquid toner pattern, onto said image transfer surface at said first transfer region and engaging said image transfer surface with said cleaning member at said cleaning region.

Preferably, the non-image pattern provides substantially full coverage of at least a portion of the image transfer surface.

Preferably, the non-image pattern comprises a pattern which covers an area on said image transfer surface corresponding to the area of said cleaning surface.

In an embodiment of the invention, the toner pattern comprises a non-continuous pattern which covers predetermined portions of the image transfer surface.

Preferably, the non-image patter is transferred to the cleaning surface. Preferably, the non-image pattern transferred to the cleaning surface acts as a collector of residual image material on the transfer surface.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
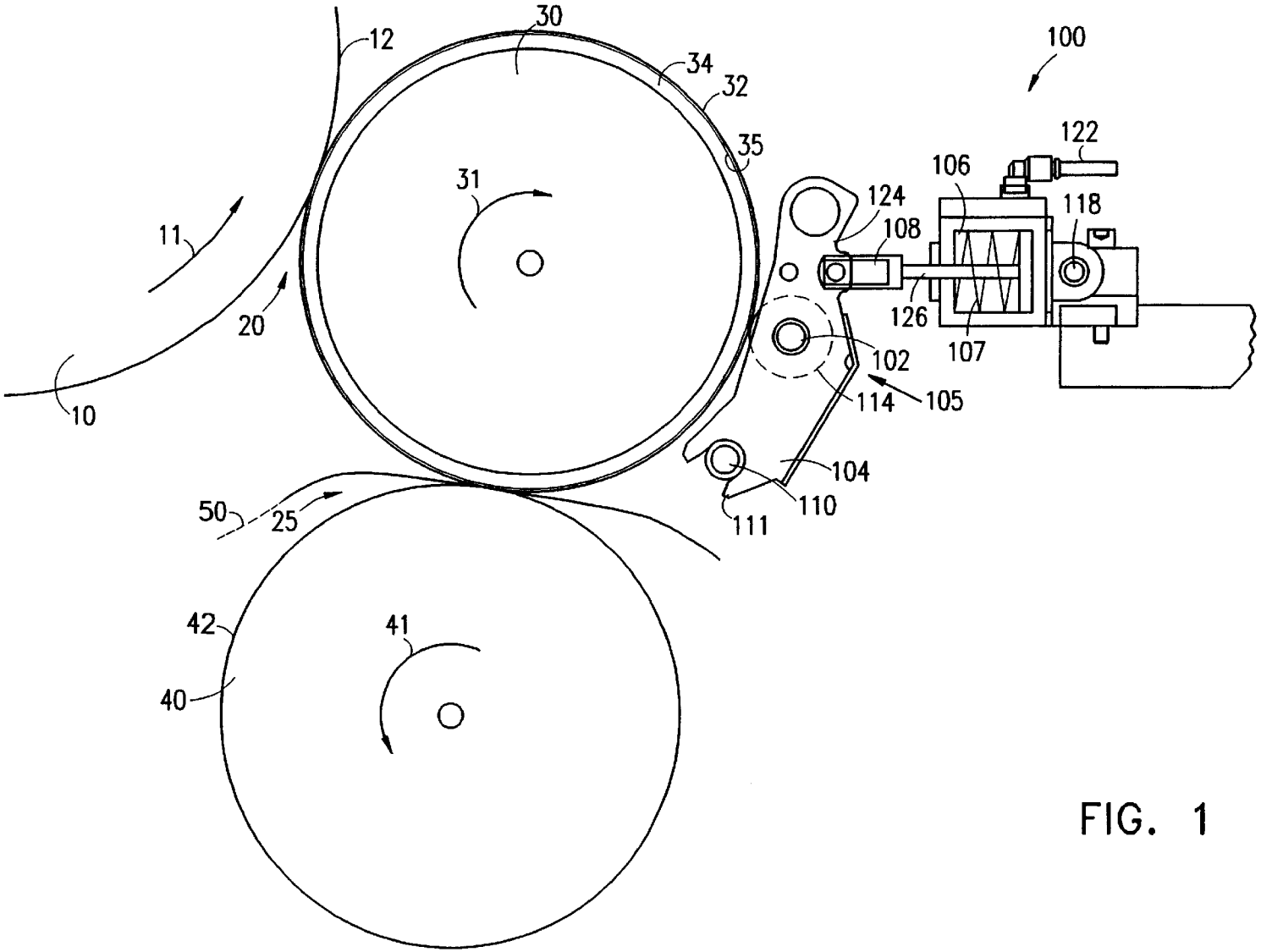
FIG. 1 is a simplified cross-sectional illustration of a portion of imaging apparatus including an arrangement for cleaning an image transfer surface, constructed and operative in accordance with a preferred embodiment of the present invention.

Reference is now made to FIG. 1 which is a simplified cross-sectional illustration of imaging apparatus including an arrangement 100 for cleaning an image transfer surface 32 of an image transfer member 30, constructed and operative in accordance with a preferred embodiment of the present invention. The imaging apparatus includes an imaging surface 12, preferably a photoreceptor surface as is known in the art, for example, as disclosed in U.S. Pat. Nos. 5,376,491 and 5,508,790, the disclosures of which are incorporated herein by reference, mounted on a drum 10 which is rotated in the direction indicated by an arrow 11. Surface 12 engages image transfer surface 32 at a first transfer region 20, where images formed on surface 12 are transferred onto surface 32. Member 30 is rotated in an opposite sense from that of drum 10, as indicated by arrow 31, so as to produce substantially zero relative motion between surface 12 and surface 32 at first transfer region 20. Image transfer member 30 preferably includes a multi-layered image transfer blanket 34 having a release layer 35, as described, for example in U.S. Pat. Nos. 5,089,856 or 5,047,808 or in PCT Publications WO 94/23347 and WO 96/11426, the disclosures of which are incorporated herein by reference; or other release layers as known in the art.

As is known in the art, member 30 is maintained at a suitable voltage and temperature for electrostatic transfer of a toner image from imaging surface 12. The toner image is preferably subsequently transferred from intermediate transfer member 30 onto a final substrate 50, such as a paper or polymer substrate, preferably by heat and pressure, at a second transfer region 25. Pressured contact between surface 32 of member 30 and substrate 50 at region 25 is preferably provided by an impression roller 40 which rotates in a direction opposite that of member 30, as indicated by arrow 41. Such second transfer is very well known in the art.

In some preferred embodiments of the present invention, multi-color images are produced by sequentially transferring a plurality of single color images, in alignment, onto surface 32 of member 30. A complete multi-color image formed of the plurality of single color images is subsequently transferred, in one action, onto the surface of final substrate 50. In these preferred embodiments of the present invention, substrate 50 is inserted into region 25 and urged against surface 32 by impression roller 40 only during the transfer of the multi-color image. Between multi-color transfers, intermediate transfer member 30 and impression roller 40 are disengaged. Alternatively, each single color image may be separately transferred to substrate 50 via intermediate transfer surface 32, as known in the art.

In some preferred embodiments of the present invention, a plurality of toner images are sequentially printed on a single, continuous, substrate 50, as described, for example in PCT publications WO 96/01442 and WO 96/31809. In these preferred embodiments of the present invention, substrate 50 is not continuously in contact with image transfer surface 32 of member 30, in order to enable repositioning of substrate 50 vis-a-vis surface 32 between imaging cycles. As described below, substrate 50 is also disengaged from surface 32 during cleaning and/or surface renewal sessions in accordance with preferred embodiments of the present invention.

As described above, image transfer blanket 34 preferably includes release layer 35 which is outermost on the blanket when it is mounted on member 30. Release layer 35 is preferably about 100 micrometers thick and is preferably formed of a silicone material. Details of a preferred release layer 35, including preferred processes of forming release layers, are described in the aforementioned PCT publications WO 94/23347 and WO 96/11426.

Figure 2:
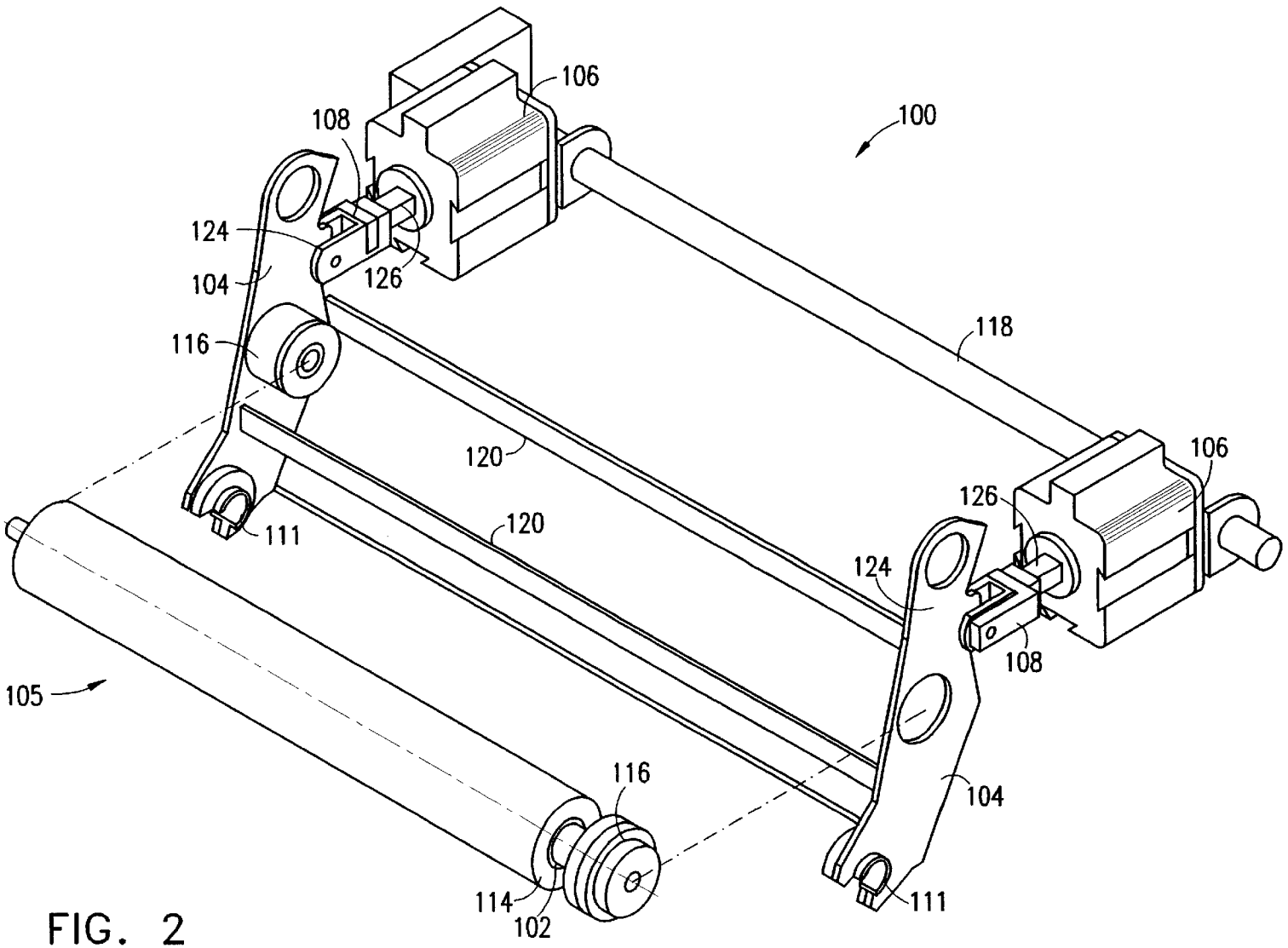
FIG. 2 is a perspective view of the cleaning arrangement of FIG. 1, showing a cleaning roller thereof in a dismounted condition.

Reference is now made also to FIG. 2 which schematically illustrates a perspective view of a preferred cleaning arrangement 100, showing a cleaning roller 105 thereof in a dismounted condition. As shown in FIGS. 1 and 2, cleaning arrangement 100 includes carrier arms 104 having fork-shaped bottom ends 111 which are supported on pivot axles 110, such that arms 104 are pivotable about axles 110. Arms 104 are substantially parallel and are preferably supported by connecting bars 120. Cleaning roller 105 is mounted between parallel arms 104 using bearings 116 which enable free rotation of roller 105 about its longitudinal axis. Axles 110 are preferably fixedly mounted to a support structure of the imaging apparatus.

Figure 3:
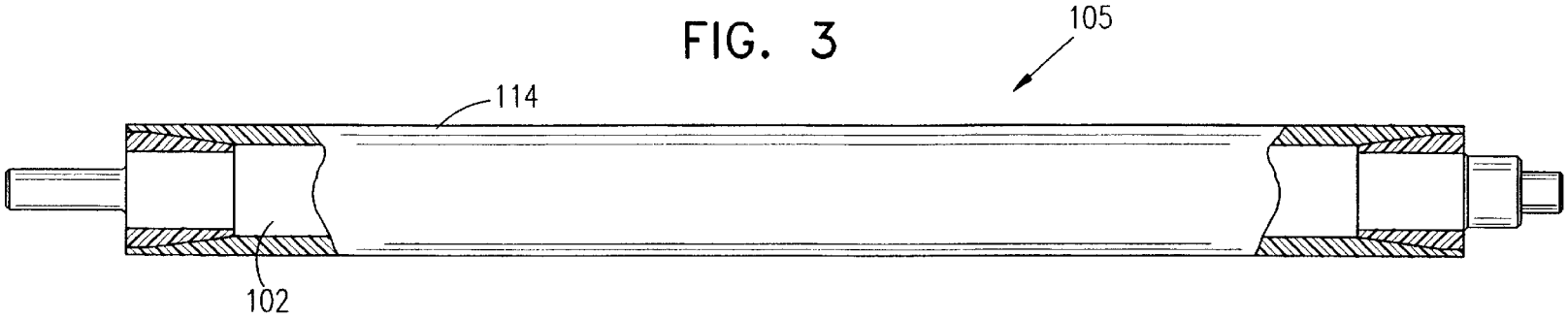
FIG. 3 is a partial cross-sectional illustration of the construction of the cleaning roller according to a preferred embodiment of the invention.

Roller 105 (shown in greater detail in FIG. 3) preferably includes an inner, preferably metal, core 102 covered with layer 114 of a relatively soft resilient material such as polyurethane. Preferably, the layer has a thickness of 25–35 micrometers at the center of the roller and a Shore A hardness of 20–25. Layer 114 is thinner at the ends of the roller in order to provide higher pressure thereat to aid in removing toner which tends to accumulate along the edges of the intermediate transfer member. It should be clear that thicker or thinner layers and/or harder or softer material may be used for layer 114 depending, inter alia, on the characteristics of the intermediate transfer member, the toner and the temperature of the roller. Layer 114 has been found to be sufficiently sticky to toner on surface 32 of member 30 to enable efficient collection of residual toner, as described, in detail, below.

In a preferred embodiment of the invention, as shown in FIGS. 1 and 2, upper portions 124 of arms 104 are connected, via connectors 108, to respective pistons 126 of actuators 106, which preferably include air-pressure actuators. When air pressure is supplied to actuators 106, via air-pressure inlet 122, pistons 126 move towards image transfer member 30 pushing connectors 108 which, in turn, push upper portions 124 of arms 104. This results in forceful motion of cleaning roller 105 towards member 30, urging the surface of layer 114 of roller 105 against image transfer surface 32. When the supply of air-pressure to actuators 106 is deactivated, springs 107 in actuators 106 push pistons 126 away from member 30, causing disengagement between roller 105 and surface 32. In a preferred embodiment of the invention, the supply of air-pressure to actuators 106 is selectively activated, to produce selective engagement between roller 105 and intermediate transfer member 30 only during cleaning and/or surface renewal sessions as described below. As further shown in FIGS. 1 and 2, actuators 106 are preferably fixedly mounted on a support rod 118 which is fixedly mounted to the support structure of the imaging apparatus.

It should be appreciated that air-pressure actuators 106 may be replaced by any suitable means known in the art for producing selective engagement between cleaning roller 105 and intermediate transfer surface 32. For example, hydraulic actuators or any other type of actuators may be used in place of actuators 106.

In accordance with preferred aspects of the present invention, sticky surface 114 is selectively brought to contact with the image transfer surface only during predefined cleaning sessions. At the beginning of each cleaning session, a liquid toner pattern, hereinafter referred to as a toner non-image, is developed on imaging surface 12, and is transferred onto surface 32 of member 30 as is known in the art. The non-image developed on surface 12 may be a "sky shot" image, i.e. an image which provides a substantially full coverage of the operative area of intermediate transfer surface 32.

Alternatively, the non-image developed on surface 12 includes a predefined pattern which does not fully cover the operative area of the image transfer surface but which is sufficiently dense to interact substantially with all residual toner on surface 32, as described below. Such a non-image is referred to herein as having "substantially full coverage." In some preferred embodiments of the invention, a series of complementary patterns are sequentially transferred onto the image transfer surface, which patterns aggregate to provide at least a substantially full coverage of at least a portion of the image transfer surface.

It should be appreciated that residual, typically deformed and generally partially fused, toner particles, accumulated over imaging cycles prior to the cleaning session, adhere to the toner non-image on image transfer surface 32. When the sticky surface of cleaning roller 105 engages surface 32, the toner non-image is removed from the image transfer surface together with the residual toner particles. Furthermore, the fresh toner transferred onto roller 105 during the cleaning session enhances the stickiness of its surface and, thus, further engagement between surface of roller 105 and surface 32, without adding additional toner, may be utilized to remove additional toner particles from surface 32.

In some preferred embodiments of the present invention, only an area of image transfer surface 32 corresponding to the area of layer 114 is covered by the non-images, whereby the stickiness of the cleaning surface is renewed with minimal wastage of liquid toner. The renewed sticky surface efficiently removes residual toner from the image transfer surface.

Since cleaning roller 105 preferably engages surface 32 only during the cleaning sessions, the cleaning roller can be positioned anywhere along the image transfer surface, e.g. along the portion of surface 32 downstream of first image transfer region 20 and upstream of second image transfer region 25, as shown in FIG. 1.

It is appreciated that the toner transferred onto layer 114 of cleaning roller 105 accumulates gradually, over many cleaning sessions, into a thick layer of dried toner which enlarges the effective diameter of cleaning roller 105. Therefore, in preferred embodiments of the present invention, the accumulated layer of toner is removed periodically from the cleaning roller. To remove the accumulated toner layer from layer 114, roller 105 is preferably dismounted, as shown in FIG. 2, and a sharp knife or other tool is used to cut through the layer of dried toner which may, then, be peeled off layer 114. Alternatively, roller 105 may be periodically replaced.

Figure 4:
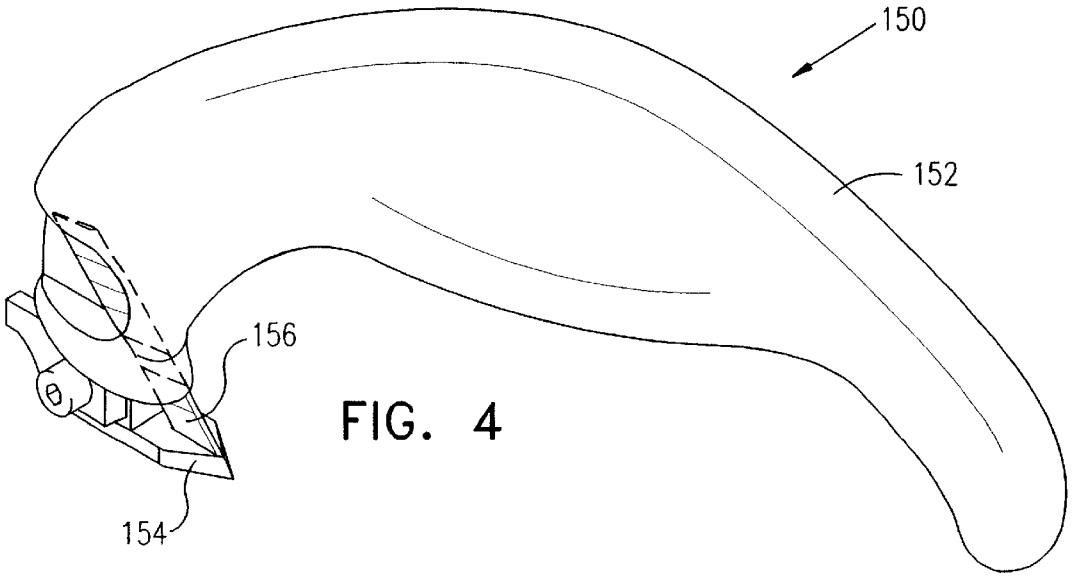
FIG. 4 is a knife usable for the removal of toner layers from the cleaning roller, in accordance with a preferred embodiment of the invention.
Figure 5:
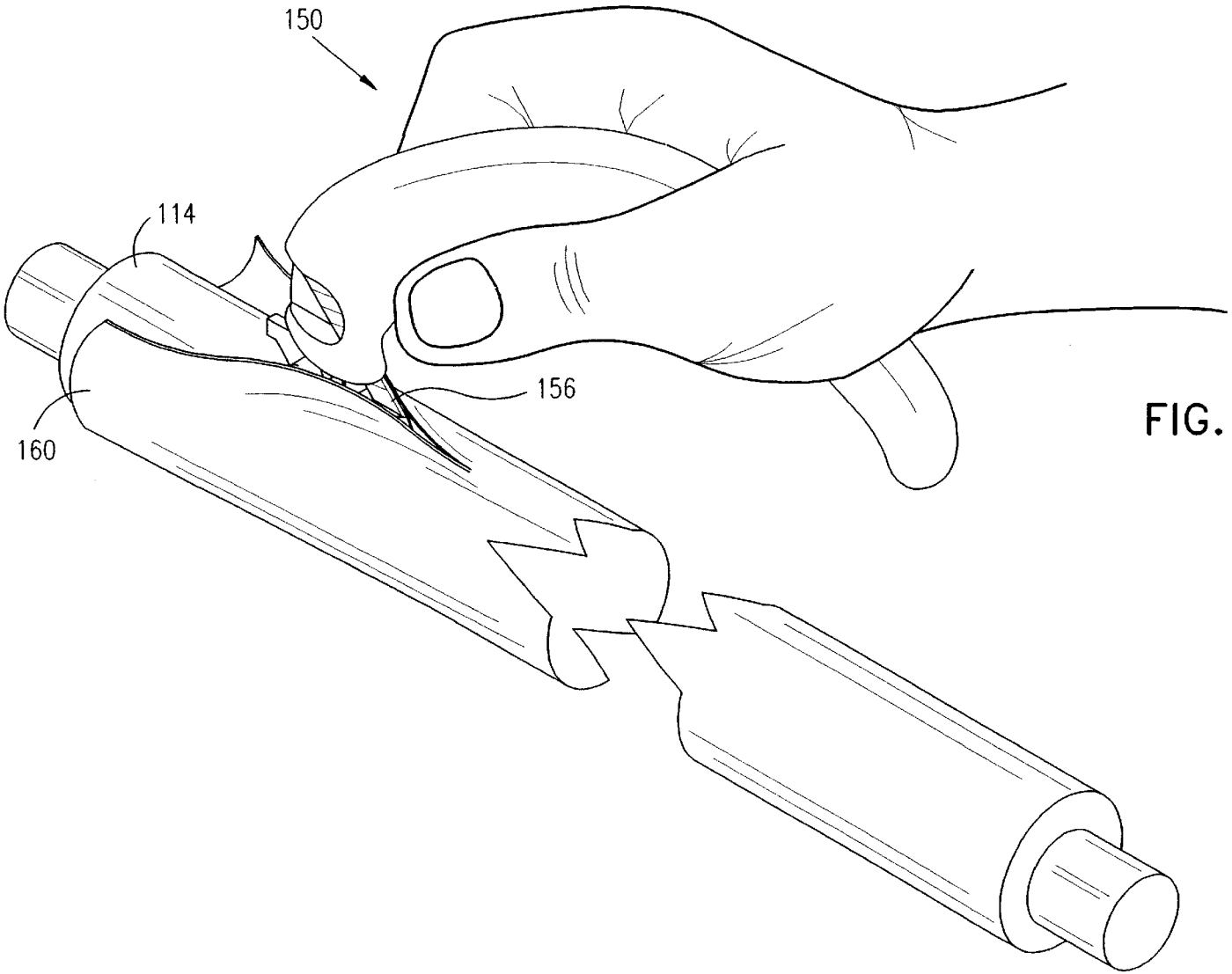
FIG. 5 shows the knife of FIG. 4 in use.

FIGS. 4 and 5 respectively show a preferred embodiment of a knife 150 suitable for removing a toner layer 160 without damaging layer 114 and an illustration of the knife performing this function. Knife 150 includes a handle 152, a lifter portion 154 mounted at one end of the of the handle and a knife blade 156 situated to cut toner layer 160 which is lifted by lifter portion 154. The lifting and cutting process is illustrated in FIG. 5.

In a preferred embodiment of the present invention, the following cleaning sequence is used for each cleaning session. First, at least one "dry run" is performed, whereby cleaning roller 105 engages surface 32 but toner is not applied to surface 32. At this stage, some of the excess liquid on roller 105 is evaporated and less deformed toner particles are collected onto its surface. Then, at least one non-image as described is transferred onto surface 32. The fresh liquid toner of the non-image collects the residual toner and is coated onto layer 114 as described above. Finally, at least one additional "dry run" is performed to ensure maximal removal of the residual toner.

In accordance with other preferred aspects of the present invention, the sticky surface of cleaning roller 105 continuously engages image transfer surface 32, collecting residual toner particles therefrom. It is appreciated, however, that the residual toner, which is typically dry and deformed, degrades the stickiness of the surface. Therefore, according to these aspects of the present invention, a toner non-image as described above is periodically transferred onto the surface of the intermediate transfer member to renew the stickiness of the surface of roller 105. The non-image, which includes fresh liquid toner, is collected by cleaning roller 105 and a layer of fresh toner is coated onto layer 114. As described above, the renewed surface efficiently removes residual toner particles from surface 32. Since, in these aspects of the invention, cleaning roller 105 continuously engages the image transfer surface, the cleaning roller must be positioned downstream of second transfer region 25, contrary to the non-continuous embodiment shown in FIG. 1, which may be positioned anywhere on the intermediate transfer member.

In those systems where a plurality of toner images are accumulated on the transfer member prior to transfer therefrom, the roller must be disengaged from the transfer member while the images are being accumulated.

It should be understood that some aspects of the invention are not limited to the specific type of image forming system used and some aspects of the present invention are also useful with any suitable imaging system which forms a liquid toner image on an image forming surface and, for some aspects of the invention, with powder toner systems. Some aspects of the invention are also useful in systems such as those using other types of intermediate transfer members such as belt or continuous coated drum type transfer members. Some aspects of the invention are suitable for use with offset printing systems. The specific details given above for the image forming system are included as part of a best mode of carrying out the invention; however, many aspects of the invention are applicable to a wide range of systems as are known in the art for electrophotographic and offset printing and copying.

It will be appreciated by persons skilled in the art that the present invention is not limited by the description and example provided hereinabove. Rather, the scope of this invention is defined only by the claims which follow:

Claims:

1. An imaging device comprising:

an imaging surface on which images are formed;

an image transfer surface which receives the images onto an image transfer portion thereof at a first transfer region and from which images are transferred at a second transfer region; and a cleaning arrangement including a cleaning surface which engages said image transfer portion at a cleaning region of the transfer portion, wherein said image transfer portion receives a non-image pattern from said imaging surface at said first transfer region and wherein said cleaning surface collects said non-image pattern at said cleaning region.

2. An imaging device according to claim 1 wherein the cleaning surface is positioned to engage the image transfer portion after the image transfer portion passes the second transfer region and before it returns to the first transfer region.

3. An imaging device according to claim 1 wherein the cleaning surface continuously engages the image transfer surface.

4. An imaging device according to claim 1 wherein the non-image pattern comprises a pattern which provides substantially full coverage of at least a portion of the image transfer region.

5. An imaging device according to claim 4 wherein said non-image pattern comprises a pattern which covers an area on said image transfer surface corresponding to the area of said cleaning surface.

6. An imaging device according to claim 1 wherein said non-image pattern comprises a non-continuous pattern which covers predetermined portions of the image transfer portion.

7. An imaging device according to claim 1 wherein said non-image pattern comprises toner particles.

8. An imaging device according to claim 7 wherein the non-image pattern is formed of a liquid toner comprising said toner particles and a carrier liquid.

9. An imaging device according to claim 1 wherein the cleaning arrangement engages the image transfer surface only during predefined cleaning sessions.

10. An imaging device according to claim 1 wherein said cleaning surface comprises a surface of a cleaning roller.

11. An imaging device according to claim 1 wherein the cleaning surface comprises a sticky surface.

12. An imaging device according to claim 1 wherein the images are toner images.

13. An imaging device according to claim 12 wherein the images are formed of a liquid toner comprising toner particles and a carrier liquid.

14. A method of cleaning an image transfer surface in an imaging device comprising an imaging surface on which images are formed, an image transfer surface having an image transfer region thereon, which region receives images at a first transfer region and from which the images are transferred at a second transfer region and a cleaning member having a cleaning surface which engages the image transfer region at a cleaning region to remove residual image material remaining on the transfer surface after transfer of the images therefrom, the method comprising:

periodically developing a predefined, non-image, pattern on said imaging surface; and transferring said predefined non-image pattern onto said image transfer region at said first transfer region and engaging said image transfer surface with said cleaning member at said cleaning region.

15. A method to claim 14 wherein the non-image pattern provides substantially full coverage of at least a portion of the image transfer region.

16. A method according to claim 15 wherein non-image pattern comprises a pattern which covers an area on said image transfer region corresponding to the area of said cleaning surface.

17. A method according to claim 14 wherein said non-image pattern comprises a non-continuous pattern which covers predetermined portions of the image transfer region.

18. A method according to claim 14 wherein the pattern comprises toner particles.

19. A method according to claim 18 wherein the pattern is formed of a liquid toner comprising said toner particles and a carrier liquid.

20. A method according to claim 14 and including, transferring the non-image pattern to the cleaning surface.

21. A method according to claim 20 wherein the non-image pattern transferred to the cleaning surface acts as a collector of residual image material on the transfer region.

22. A method according to any of claims 14–21 wherein the images are toner images.

23. A method according to claim 22 wherein the images are liquid toner images comprising toner particles and a carrier liquid.

24. An imaging device according to claim 1 wherein the cleaning surface is positioned to engage the image transfer portion after the image transfer portion passes the first transfer region and before it reaches the first transfer region.

25. An imaging device according to claim 24 wherein the cleaning surface contacts the image transfer portion when said non-image pattern is printed and does not contact the surface when an image is printed.

* * * * *